US007106283B2

(12) United States Patent
Satoh

(10) Patent No.: US 7,106,283 B2
(45) Date of Patent: Sep. 12, 2006

(54) EFFICIENTLY TESTABLE DISPLAY DRIVING CIRCUIT

(75) Inventor: Shinichi Satoh, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 556 days.

(21) Appl. No.: 10/647,306

(22) Filed: Aug. 26, 2003

(65) Prior Publication Data

US 2004/0100428 A1 May 27, 2004

(30) Foreign Application Priority Data

Nov. 25, 2002 (JP) ..... 2002-341333

(51) Int. Cl.
*G09G 3/30* (2006.01)

(52) U.S. Cl. ..... 345/76; 345/36; 345/204; 345/211; 345/904

(58) Field of Classification Search ..... 345/76, 345/36, 204, 211, 904
See application file for complete search history.

(56) References Cited

U.S. PATENT DOCUMENTS 5,444,390 A * 8/1995 Bartlett et al. ..... 324/770
6,014,035 A * 1/2000 Taniguchi ..... 324/770
6,518,962 B1 * 2/2003 Kimura et al. ..... 345/211
6,633,135 B1 * 10/2003 Nara et al. ..... 315/169.3
6,762,735 B1 * 7/2004 Koyama ..... 345/76

FOREIGN PATENT DOCUMENTS

JP 11-095723 4/1999

* cited by examiner

*Primary Examiner*—Richard Hjerpe
*Assistant Examiner*—Leonid Shapiro
(74) *Attorney, Agent, or Firm*—VolentineFrancos&Whitt, PLLC

(57) ABSTRACT

A device for driving a dot matrix display panel has a number of first terminals that can be connected to different signal lines in the dot matrix display panel, to carry current to or from picture elements in the dot matrix display panel. The invented device also has a second terminal and a set of switches that can selectively connect the first terminals to the second terminal. These switches enable a measurement device connected to the second terminal to measure electrical parameters at the first terminals individually, so that the electrical parameters of the device can be tested efficiently and accurately, without having to contact each of the first terminals with a probe.

15 Claims, 2 Drawing Sheets

EFFICIENTLY TESTABLE DISPLAY DRIVING CIRCUIT

BACKGROUND OF THE INVENTION

1. Field of the Invention

The present invention relates to a display driving circuit for a current-driven display panel such as an electroluminescent (EL) panel, and more particularly to the testability of the display driving circuit.

2. Description of the Related Art

FIG. 1 shows a conventional display driving circuit, disclosed in Japanese Unexamined Patent Application Publication No. 11-95723, and illustrates how it is tested. The display driving circuit 10 drives an organic electroluminescent panel 1 to create a dot matrix display. The organic electroluminescent panel 1 comprises an intersecting grid of m data lines SGi (i=1 to m) and n scanning lines CMj (j=1 to n), where m and n are integers greater than one. Organic electroluminescent picture elements or pixels $PE_{i,j}$ are disposed at the intersections of the grid; each pixel $PE_{i,j}$ has an anode coupled to data line SGi and a cathode coupled to scanning line CMj.

The display driving circuit 10 comprises m constant-current sources $\mathbf{11}_i$ (i=1 to m), a switching unit 12, a switching unit 13, and a driving control unit 14.

The i-th constant-current source $\mathbf{11}_i$ drives data line SGi. On their input side, the constant-current sources $\mathbf{11}_i$ are connected to a shared power terminal 15 from which they receive a supply voltage VS; on their output side they are connected to electrodes (a) of switches $\mathbf{12}_i$ in the switching unit 12. The switches $\mathbf{12}_i$ also have respective electrodes (b) connected to a common ground terminal 16, to which a ground potential (GND) is supplied, and further electrodes (c) connected to respective current output terminals $\mathbf{17}_i$. Data line SGi in the organic electroluminescent panel 1 is connected to current output terminal $\mathbf{17}_i$.

The switching unit 13 comprises n switches $\mathbf{13}_j$ having respective electrodes (a) connected to the ground terminal 16, electrodes (b) connected to the power terminal 15, and electrodes (c) connected through respective terminals $\mathbf{18}_j$ to the corresponding scanning lines CMj in the organic electroluminescent panel 1.

The driving control unit 14 controls the switching units 12, 13 according to display data DT received from a data input terminal 19.

In this type of display driving circuit 10, the switches $\mathbf{13}_j$ in switching unit 13 are selected cyclically, one at a time, by the driving control unit 14, and switch over to their a-electrodes when selected. The scanning line CMj in the organic electroluminescent panel 1 corresponding to the selected switch $\mathbf{13}_j$ is thereby connected to ground, while the other (non-selected) scanning lines are connected to the power-supply voltage VS.

The switches $\mathbf{12}_i$ in switching unit 12 operate under control of the driving control unit 14 according to the data to be displayed on the selected scanning line. Pixel $PE_{i,j}$ in the organic electroluminescent panel 1 emits light if switches $\mathbf{12}_i$ and $\mathbf{13}_j$ are both set to the a-side, so that current supplied by constant-current source $\mathbf{11}_i$ flows through pixel $PE_{i,j}$ to ground. As switching unit 13 selects the scanning lines CMj in sequence, the emitted light produces a dot matrix display.

The organic electroluminescent panel 1 and its display driving circuit 10 are manufactured separately and tested as independent units. The display driving circuit 10 is fabricated on a semiconductor wafer and undergoes various electrical tests in the semiconductor wafer state. If it passes these tests, then after the wafer has been diced into chips, the display driving circuit 10 is packaged and connected to the organic electroluminescent panel 1. Accurate testing of the constant-current sources $\mathbf{11}_i$ is particularly necessary, because the uniformity of the current output therefrom has a major effect on the quality of the display. If the constant-current sources $\mathbf{11}_i$ do not output uniform amounts of current, the pixel elements cannot put out uniform amounts of light.

The display driving circuit 10 is tested in the wafer state by a testing apparatus 30 of the type shown in FIG. 1. The testing apparatus 30 has a switch setting unit 31 that supplies data DT to the driving control unit 14 to set the switches in the switching units 12, 13, a constant voltage source 32 that supplies voltage VP to the constant voltage source 32, a constant voltage source 33 that outputs a lower voltage, and an ammeter 34 connected in series with the constant voltage source 33. The testing apparatus 30 also has a constant-current source 35 that supplies current to switching unit 13 and a voltmeter 36 that measures the resulting voltage drop. The testing apparatus 30 is connected to the display driving circuit 10 by a cable equipped with probes.

In this configuration, the ammeter 34 is connected to the current output terminals $\mathbf{17}_i$ of the display driving circuit 10 one after another, and measures the current supplied by the corresponding constant-current sources $\mathbf{11}_i$. The constant-current source 35 and voltmeter 36 are connected to the scanning terminals $\mathbf{18}_j$ of the display driving circuit 10 one after another, and measure the voltage drops on the different paths leading through the switches $\mathbf{13}_j$ in switching unit 13. A decision is then made as to whether the measured currents and voltages are within specified tolerance limits.

One problem with this type of test is that it takes too much time, since the probes have to be moved repeatedly from one terminal to another, and each time a probe is moved to a new terminal, a certain time must be allowed before the flow of current stabilizes and accurate values can be measured.

Another problem is that the test results tend to vary according to random variations in the force with which the probes make contact with the terminals, the area of contact, and other such factors. To ensure the quality of the display, tight tolerances are set on the test results, so random variations can easily cause a device that actually meets its specifications to be rejected as defective.

SUMMARY OF THE INVENTION

An object of the present invention is to provide an efficiently testable device for driving a dot matrix display panel.

Another object is to provide an accurately testable device for driving a dot matrix display panel.

The invented device for driving a dot matrix display panel has a plurality of first terminals connected to different signal lines in the dot matrix display panel, for carrying current to or from the picture elements in the dot matrix display panel. The invented device also has a second terminal and a plurality of switches for selectively connecting the first terminals to the second terminal. These switches enable test apparatus connected to the second terminal to measure electrical parameters at the first terminals individually.

The invented device can be tested efficiently because it is not necessary to contact each of the first terminals individually with a probe.

The invented device can be tested accurately because the test results are not affected by contact force, contact area, and other factors that may vary from one terminal to another.

The first terminals may be current output terminals connected to different data signal lines in the dot matrix display panel, and the measured electrical parameters may be current values.

Alternatively, the first terminals may be scanning terminals connected to different scanning signal lines in the dot matrix display panel, and the measured electrical parameters may be voltage drops.

The invention also provides a device with switches for connecting current output terminals to one test terminal and switches for connecting scanning terminals to another test terminal, so that electrical parameters can be measured at both types of terminals.

DETAILED DESCRIPTION OF THE INVENTION

Figure 1:
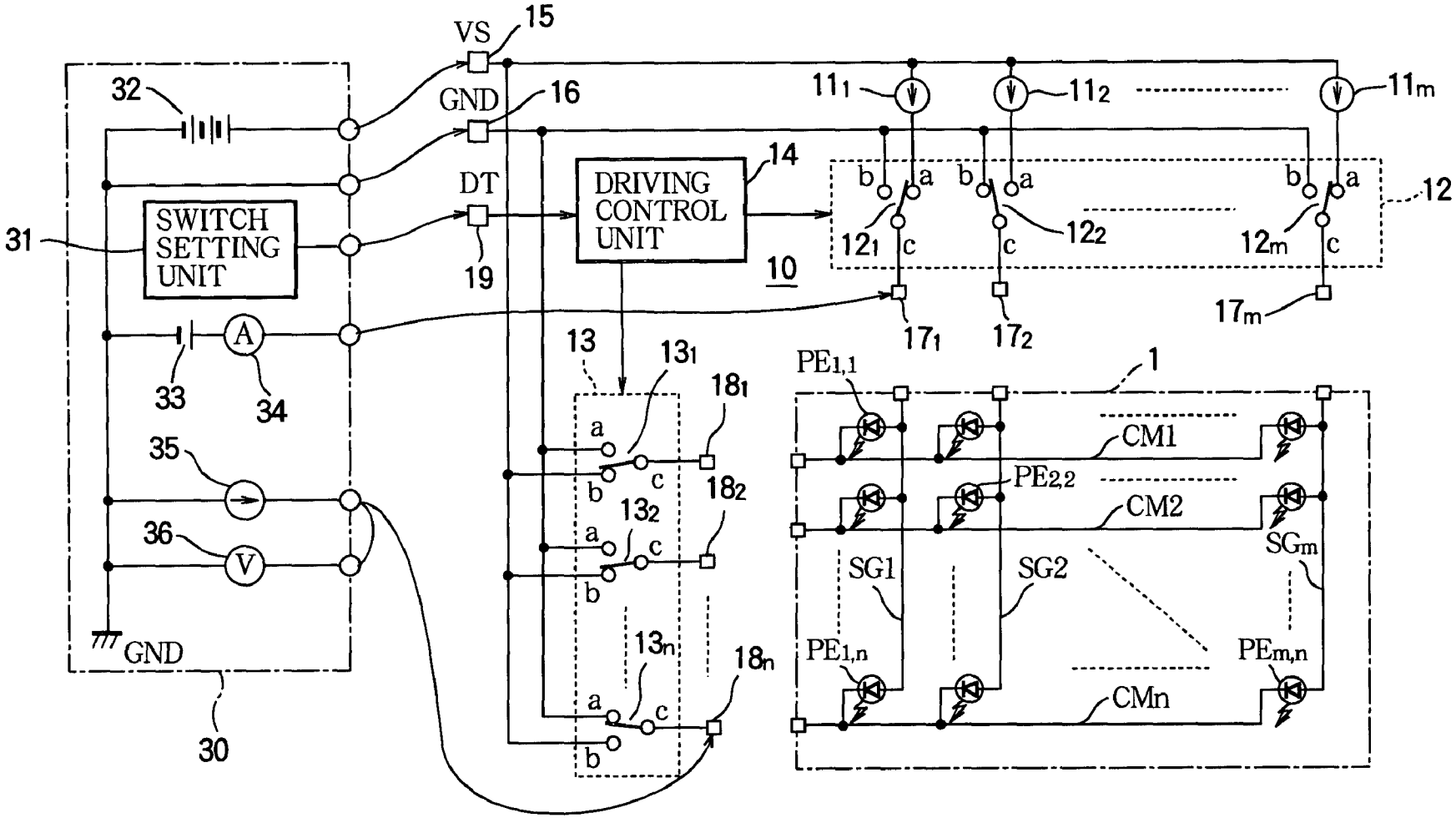
FIG. 1 PRIOR ART
FIG. 1 is a circuit diagram illustrating a conventional display driving circuit and test circuit.

An embodiment of the invention will now be described with reference to FIG. 2, in which elements similar to the corresponding elements in FIG. 1 are indicated by the same reference characters.

Figure 2:
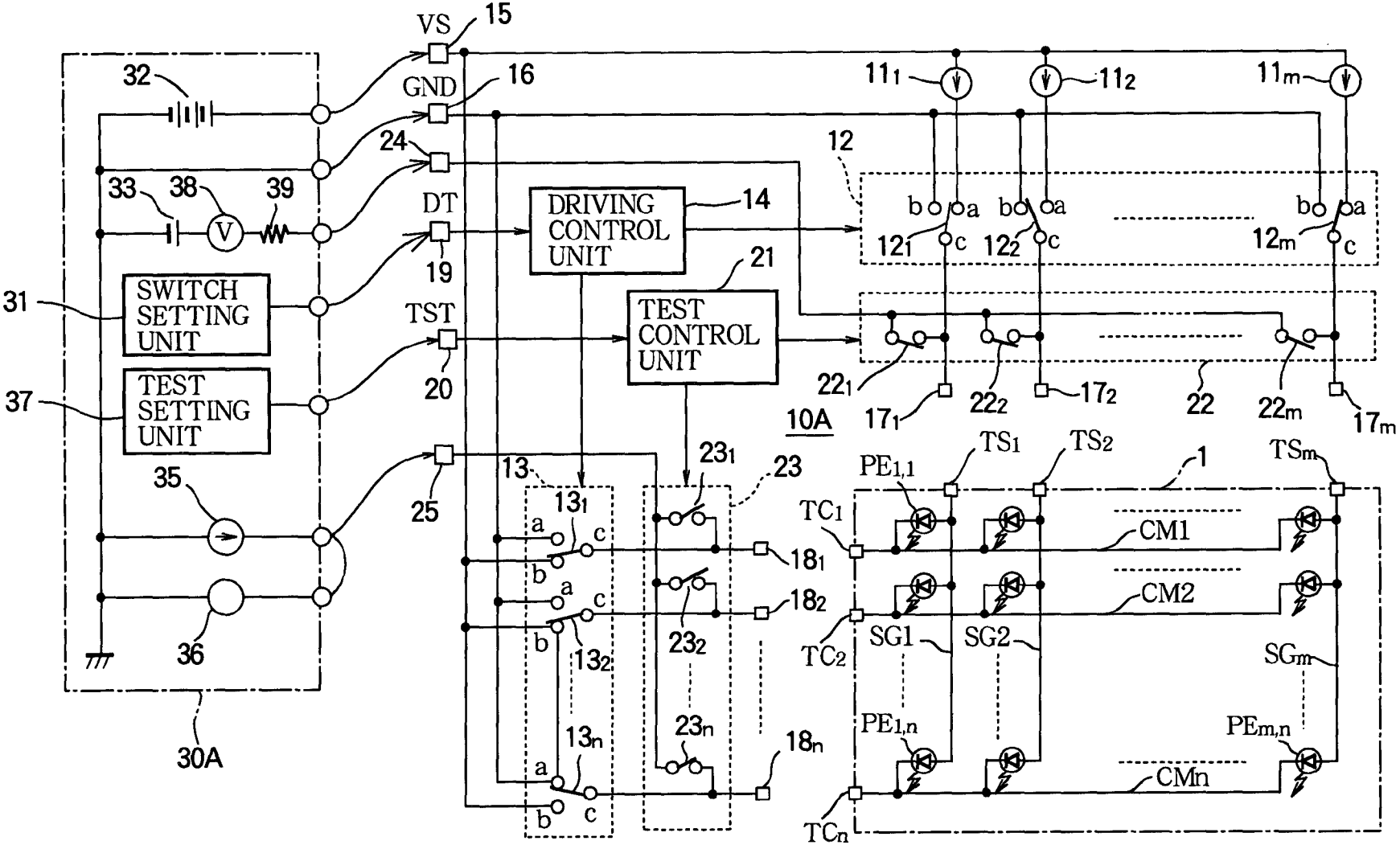
FIG. 2 is a circuit diagram illustrating a conventional display driving circuit and test circuit embodying the present invention.

The display driving circuit 10A in FIG. 2 drives an organic electroluminescent panel 1 to generate a dot matrix display. The organic electroluminescent panel 1 is of the conventional type comprising an intersecting grid of data lines SGi and scanning lines CMj with organic electroluminescent pixels $PE_{i,j}$ disposed at the grid intersections, the pixels being connected by their anodes to the data lines and by their cathodes to the scanning lines. The data lines SGi have respective terminals $TS_i$ (i=1 to m) at which they are connected to the display driving circuit 10A; the scanning lines CMj have respective terminals $TC_j$ (j=1 to n) at which they are connected to the display driving circuit 10A (m and n are integers greater than one).

The display driving circuit 10A includes the conventional constant-current sources $\mathbf{11}_i$, switching units 12, 13, driving control unit 14, common power terminal 15, common ground terminal 16, current output terminals $\mathbf{17}_i$, scanning terminals $\mathbf{18}_j$, and data input terminal 19, and a novel test control unit 21, test switching unit 22, and test switching unit 23.

The i-th constant-current source $\mathbf{11}_i$ supplies a constant current to drive the pixel elements $PE_{i,j}$ connected to data line SGi. The constant current value is typically in the range from several tens of microamperes to several hundred microamperes. Each constant-current source $\mathbf{11}_i$ receives a power-supply potential or supply voltage VS from the common power terminal 15, and supplies current to the a-electrode of switch $\mathbf{12}_i$ in switching unit 12. The b-electrode of switch $\mathbf{12}_i$ is coupled to the common ground terminal 16, and the c-electrode of switch $\mathbf{12}_i$ is coupled to the current output terminal $\mathbf{17}_i$ that connects with terminal $TS_i$ in the organic electroluminescent panel 1. After the display driving circuit 10A has been connected to the organic electroluminescent panel 1, the c-electrode of switch $\mathbf{12}_i$ is thereby connected to data line SGi.

The switches $\mathbf{13}_j$ in switching unit 13 have their a-electrodes connected to the common ground terminal 16, their b-electrodes connected to the common power terminal 15, and their c-electrodes connected to scanning terminals $\mathbf{18}_j$ that connect to the corresponding terminals $TC_j$ in the organic electroluminescent panel 1, thus to the scanning lines CMj.

The switches $\mathbf{12}_i$, $\mathbf{13}_j$ operate under control of the driving control unit 14, connecting their c-electrodes selectively to their a-electrodes and b-electrodes. The driving control unit 14 operates according to the data DT received at the data input terminal 19.

A test signal TST received at a test control terminal 20 controls the test control unit 21, which in turn controls the test switching units 22 and 23. Test switching unit 22 comprises on-off switches $\mathbf{22}_i$ through which the corresponding current output terminals $\mathbf{17}_i$ can be selectively coupled to a test output current terminal 24. Test switching unit 23 comprises on-off switches $\mathbf{23}_j$ through which the corresponding scanning terminals $\mathbf{18}_j$ can be selectively coupled to a test input current terminal 25.

Next the electrical testing of the display driving circuit 10A in the wafer state will be described.

As shown in FIG. 2, the test apparatus 30A comprises the conventional switch setting unit 31, constant voltage sources 32, 33, constant-current source 35, and voltmeter 36, and a novel test setting unit 37, voltmeter 38, and resistor 39.

The switch setting unit 31 supplies data DT to the data input terminal 19 of the display driving circuit 10A. The constant voltage source 32 supplies a supply voltage VP (for example, 7 V) to the power terminal 15 of the display driving circuit 10A. The constant voltage source 33 outputs a voltage (for example, 4 V) corresponding to the voltage drop that occurs in an organic electroluminescent pixel $PE_{i,j}$ when the pixel is driven. The constant-current source 35 supplies the test input current terminal 25 of the display driving circuit 10A with a current (of several tens of milliamperes, for example) equivalent to the maximum current that may be carried on a scanning line CMj in the organic electroluminescent panel 1. The voltmeter 36 measures the voltage at the test input current terminal 25.

The test setting unit 37 is connected to the test control terminal 20 of the display driving circuit 10A, and outputs a test signal TST that controls the test control unit 21, thereby controlling the switches in the test switching units 22, 23.

The voltmeter 38 and resistor 39 are connected in series between the constant voltage source 33 and the test output current terminal 24 of the display driving circuit 10A. By measuring the voltage at a point between constant voltage source 33 and resistor 39, the voltmeter 38 obtains a value proportional, by Ohm's law, to the current flowing through resistor 39.

In the test procedure, the switch setting unit 31 and test setting unit 37 drive the data signal DT and test control signal TST in a predetermined pattern. The driving control unit 14 sets the switches in the switching units 12, 13 according to the data signal DT. The test control unit 21 sets the switches in the test switching unit 22, 23 according to the test control signal TST.

The current output by the constant-current sources $\mathbf{11}_i$ is measured by having the switches $\mathbf{12}_i$ in switching unit 12 connect the constant-current sources $\mathbf{11}_i$ to the current output terminals $\mathbf{17}_i$, and having the switches $\mathbf{22}_i$ in test switching unit 22 connect the test output current terminal 24 to terminals $17_1$ to $17_m$ in turn. Since the current is measured by measuring the voltage drop in resistor 39, and since it is not necessary to connect and disconnect a probe for each individual measurement, the outputs of all of the constant-current sources $11_i$ can be measured quickly, and little current is consumed in the measurement process.

The voltage drop on different electrical paths through the switching unit 13 is measured in a similar way. The switches $23_j$ in the test switching unit 23 connect the scanning terminals $18_j$ to the test input current terminal 25 in turn. The switches $13_j$ in switching unit 13 are set to connect the a-terminal to the c-terminal, to measure the voltage drop on the current path leading to ground. Measurement of the voltage drops on all current paths in switching unit 13 can be completed quickly because it is not necessary to connect and disconnect probes, and the measurement process consumes little current.

The invented display driving circuit 10A can be tested efficiently in that the test procedure can be completed quickly without using very much current. The display driving circuit 10A can also be tested accurately, because the test results are not affected by variations in electrical contact quality at different terminals.

If the measured voltages and currents are within specified tolerances, then after the display driving circuit 10A has been diced from the wafer, it is packaged and connected to the organic electroluminescent panel 1, with the switches $22_i$, $23_j$ in the test switching units 22, 23 all placed permanently in the off state. During subsequent operation, the display driving circuit 10A operates in the same way as the conventional display driving circuit 10.

The present invention is not limited to the embodiment described above. For example, the display driving circuit 10A is not limited to driving an organic electroluminescent panel 1; any type of current-driven matrix display panel may be driven. The potentials supplied to the common terminals 15, 16 can be any two different potentials, not necessarily a power-supply potential and ground potential.

The test apparatus 30A is not limited to the configuration shown. Other test equipment configurations and measurement methods are possible.

The display driving circuit 10A need not have test switching units 22, 23 for both the data lines SGi and scanning lines CMj. The invention can be practiced with just one of these two test switching units.

Those skilled in the art will recognize that further variations are possible within the scope of the invention, which is defined by the appended claims.

What is claimed is:

1. A device for driving a dot matrix display panel, comprising:

a plurality of first terminals connected to different signal lines in the dot matrix display panel for carrying current to or from picture elements in the dot matrix display panel;

a second terminal; and a plurality of switches for selectively connecting the first terminals to the second terminal, enabling a measurement device connected to the second terminal to measure electrical parameters at the first terminals individually.

2. The device of claim 1, wherein the first terminals are connected to different data signal lines in the dot matrix display panel.

3. The device of claim 2, wherein the measured electrical parameters are current values.

4. The device of claim 1, wherein third terminals are connected to different scanning signal lines in the dot matrix display panel.

5. The device of claim 4, wherein the measured electrical parameters are voltage drop values.

6. A device for driving a dot matrix display panel, comprising:

a plurality of constant-current sources;

a plurality of first terminals for connection to different data signal lines in the dot matrix display panel;

a plurality of first switches for selectively connecting the constant-current sources to the first terminals responsive to respective data signals, thereby supplying current to the data signal lines in the dot matrix display panel;

a second terminal for connection to test apparatus; and a plurality of second switches for selectively coupling the first terminals to the second terminal, thereby enabling the test apparatus to measure the current supplied from the constant-current sources to different ones of the first terminals individually.

7. The device of claim 6, further comprising:

a test control terminal for receiving a test control signal from the test apparatus; and a test control circuit connected to the test control terminal, for controlling the second switches according to the test control signal.

8. The device of claim 6, further comprising:

a plurality of third terminals for connection to different scanning signal lines in the dot matrix display panel;

a plurality of third switches for selectively connecting each the third terminals to two different potentials;

a fourth terminal; and a plurality of fourth switches for selectively connecting the third terminals to the fourth terminal, thereby enabling the test apparatus to measure voltage drops in the third switches.

9. The device of claim 8, further comprising:

a test control terminal for receiving a test control signal from the test apparatus; and a test control circuit connected to the test control terminal, for controlling the second switches and the fourth switches according to the test control signal.

10. The device of claim 8, wherein said two potentials are a power-supply potential and a ground potential.

11. The device of claim 6, wherein the dot matrix display panel is an electroluminescent panel.

12. A device for driving a dot matrix display panel, comprising:

a plurality of constant-current sources;

a plurality of first terminals for connection to different data signal lines in the dot matrix display panel;

a plurality of first switches for selectively connecting the constant-current sources to the first terminals responsive to respective data signals, thereby supplying current to the data signal lines in the dot matrix display panel;

a second terminal for connection to test apparatus;

a plurality of third terminals for connection to different scanning signal lines in the dot matrix display panel;

a plurality of second switches for selectively connecting each the third terminals to two different potentials; and a plurality of third switches for selectively connecting the third terminals to the second terminal, thereby enabling the test apparatus to measure voltage drops in the second switches.

13. The device of claim 12, further comprising:

a test control terminal for receiving a test control signal from the test apparatus; and a test control circuit connected to the test control terminal, for controlling the fourth switches according to the test control signal.

14. The device of claim 12, wherein said two potentials are a power-supply potential and a ground potential.

15. The device of claim 12, wherein the dot matrix display panel is an electroluminescent panel.

* * * * *